United States Patent [19]

Amani

[11] Patent Number: 4,901,798

[45] **Date of Patent: * Feb. 20, 1990**

[54] APPARATUS AND METHOD FOR REMOVAL OF ACCUMULATED LIQUIDS IN HYDROCARBON PRODUCING WELLS

[76] Inventor: Mahmood Amani, P.O. Box 409, Kingsville, Tex. 78364

[ * ] Notice: The portion of the term of this patent subsequent to Dec. 20, 2005 has been disclaimed.

[21] Appl. No.: 226,264

[22] Filed: Jul. 29, 1988

Related U.S. Application Data

[63] Continuation-in-part of Ser. No. 867,191, May 27, 1986, Pat. No. 4,791,990.

[51] Int. Cl.[4] ..... E21B 34/10; E21B 43/12

[52] U.S. Cl. ..... 166/311; 166/53; 166/322; 166/324; 166/372; 166/373; 417/120; 417/132; 417/143

[58] Field of Search ..... 166/53, 72, 250, 306, 166/305.1, 311, 313, 322, 373–375, 369–372, 386, 332, 321; 405/53, 59; 251/62; 417/118, 120, 138, 142, 143

[56] References Cited

U.S. PATENT DOCUMENTS

| | | | |
|---|---|---|---|
| 1,523,709 | 1/1925 | Pendleton | 417/142 |
| 3,363,692 | 1/1968 | Bishop | 166/306 |
| 3,894,814 | 7/1975 | Morgan | 417/138 X |
| 4,275,790 | 6/1981 | Abercrombie | 166/53 X |
| 4,378,931 | 4/1983 | Adams, Jr. | 166/332 X |
| 4,427,345 | 1/1984 | Blann et al. | 417/143 X |
| 4,429,740 | 2/1984 | Malinchak | 166/53 |
| 4,522,370 | 6/1985 | Noack et al. | 166/323 X |

*Primary Examiner*—Bruce M. Kisliuk
*Attorney, Agent, or Firm*—David A. Rose

[57] ABSTRACT

A method and apparatus are disclosed to detect periodic well loading by produced accumulated secondary fluids, and accordingly to remove the undesired secondary fluid from the tubing of a hydrocarbon producing well. The method according to the present invention employs a surface control system that controls the operation of the fluid removal cycle, and the production cycle of the hydrocarbon producing well. Periodically, the well is "shut-in" and upper and lower flow control valves, connected at a predetermined depth to the well tubing, are actuated to a closed position to form an accumulation chamber within the tubing. The closed flow control valves block off the fluid in the accumulation chamber formed in the lower portion of the tubing string, which contains the undesired accumulated secondary fluids. A supply line is used to inject pressurized gas from the surface of the well into the accumulation chamber to provide the necessary pressure to force the accumulated secondary fluids, trapped in the accumulation chamber, through a relief valve and into the annulus of the well casing thereby removing the undesired secondary fluids from the well tubing. The controller then stops the flow of the injected gas to the supply line to stop the removal cycle. The supply line pressure is relieved, and the pressure across the flow control valves are equalized. The flow control valves are then opened and the producing well is returned to production with reduced back pressure due to the removal of the undesired, accumulated secondary fluids from the tubing.

16 Claims, 15 Drawing Sheets

APPARATUS AND METHOD FOR REMOVAL OF ACCUMULATED LIQUIDS IN HYDROCARBON PRODUCING WELLS

RELATED APPLICATION

This application is a continuation-in-part application of Serial No. 867,191, filed May 27, 1986 now U.S. Pat. No. 4,791,990.

BACKGROUND OF THE INVENTION

This invention relates to a method and apparatus to remove the accumulated liquids from hydrocarbon producing wells for the purpose of improving production. Many hydrocarbon producing wells produce, along with the gas, liquids such as water, oil and condensate. A mixture of these fluids flows from the producing formation through casing or tubing to surface facilities. The liquid is entrained as droplets in the gas flow. Part of this entrained liquid will drop out of the flow due to insufficient velocity of the gas and will accumulate in the wellbore. Ultimately this liquid will build up to a height which will exert a hydrostatic pressure which may be large enough to reduce the production rate or completely stop production of the hydrocarbons. This condition is referred to as "well loading".

It is therefore advantageous to periodically remove or reduce the accumulated liquid from producing wells. By removing the liquid which has accumulated in the well, the hydrostatic pressure exerted by the accumulated liquid against the producing formation pressure will be reduced. Thus the fluid from the formation will enter the wellbore at much higher velocity and the gas will carry the produced liquids to the surface more effectively.

DISCUSSION OF PRIOR ART

In the past, methods have been used to remove the accumulated liquid in the tubing of a hydrocarbon producing well to improve its producing capability. One common method has been to allow liquids to accumulate in a downhole accumulation chamber. The accumulation chamber may be the well tubing string, the annulus, or an accumulation means attached to the well tubing. Periodically the liquid is forced out of the accumulation chamber by gas pressure or formation pressure and is removed from the well. The accumulation chamber is bled off in order to allow it to refill, and the process is repeated. This known method requires a large volume of high pressure gas to displace the undesired liquid from the tubing, therefore making the method inefficient or limiting the method to shallow wells.

U.S. Pat. No. 3,363,692 describes a method in which gas is produced through the casing annulus space upwardly to the surface. The water rises under pressure of the hydrocarbon producing formation into the tubing. When the hydrostatic pressure of the water column in the tubing overcomes the pressure of the water bearing formation, the liquid is allowed to pass downwardly through a bypass to enter a water bearing formation which is open to the well bore. In another embodiment of the U.S. Pat. No. 3,363,692, hydrocarbons are produced through the annulus and the tubing is used as a liquid accumulation chamber. The tubing is vented to the atmosphere so that the water is able to rise in the tubing to a maximum height. A timed cycle controller at the surface connects the annulus to the tubing to provide additional pressure to force the water out of the tubing for disposal.

Methods such as those disclosed in the prior art have proven to be ineffective for the following reasons:

1. In many cases the hydrocarbon producing formation pressure is not sufficient to inject liquids into a water bearing formation at a desired rate;

2. A low pressure formation produces more effectively through tubing; and

3. Venting natural gas to the atmosphere is wasteful.

U.S. Pat. No. 2,942,663 describes a method in which the accumulated liquid in the tubing is first displaced downwardly by forcing a gas into the top of the well tubing. The forced gas flow is stopped after the liquid level of the accumulated liquid has been lowered only part of the way to the desired depth. Liquid is then forced into the tubing above the gas column until the level of accumulated liquid below the gas column has been reduced to the desired depth. This causes the gas column to be further compressed without increasing the pressure at the well head. The pressure is then released at the top of the well and the expansion of the gas column forces the liquid above the column from the well. This method requires the total volume of the tubing to be filled partly with natural gas and partly with liquid and pressurized to the displacement pressure. The time lag between filling and venting the tubing, and the possibility that the liquid pumped into the tubing may not be recoverable from the tubing by gas expansion makes this method ineffective.

The flow control valve of this invention is biased to the open position. All prior art flow control valves better known as safety valves are biased to closed position. U.S. Pat. No. 4,378,931 to Adams discloses a fluid pressure actuated flow control valve which is not biased to the open or closed positions. Adams discloses a valve having a spring which is only used as a means to absorb or impose the closing force to the actuator. Adams does not teach a valve having resilient urging means to bias the flow control valve to open position.

Other prior art flow control valves which are controlled by two hydraulic control lines such as the safety valve described in U.S. Pat. 4,201,363, utilizes resilient urging means to close the safety valve in order to accomplish the objectives of a safety valve. The hydraulically controlled form of the flow control valve of this invention differs from the prior art in that it utilizes resilient urging means to bias the flow control valve to the open position.

The present invention provides an improved apparatus and method to remove the accumulated liquid(s) from the tubing of a hydrocarbon producing well by minimizing the volume of pressurized gas required to displace the undesired liquid from the tubing into the casing annulus for disposal into a water bearing formation. This invention also provides a control on the desired frequency to remove liquid(s) from the tubing of a hydrocarbon producing well.

SUMMARY OF THE INVENTION

The primary object of this invention is to provide an improved method and apparatus to periodically remove the accumulated liquid in the tubing of a hydrocarbon producing well to reduce the back pressure which is exerted on the hydrocarbon producing formation due to the weight of the accumulated liquid in the tubing.

Another object of this invention is to provide a surface control system to monitor the back pressure build up which is exerted on the producing formation due to the accumulation of liquids in the well tubing and accordingly perform the operation of the liquid disposal and hydrocarbon production cycles.

Another object is to provide a flow control valve which has resilient urging means to yieldably move the valve toward an open position in which the valve may operate in its normal mode. Fluid pressure transmitted through a pipe extending from the well surface to the valve acts to move the flow control valve toward its closed position.

Another object of the invention is to provide a flow control valve biased to the open position for connection to the well tubing. The flow control valve has resilient urging means to yieldably move the valve toward an open position in which the valve may operate in its normal mode. The closing of the flow control valve is controlled by induced fluid pressure in a first hydraulic control conduit extending between the surface and the flow control valve in the casing annulus. The hydrostatic pressure of fluid in a second control conduit extending between the surface and the flow control valve balances the hydrostatic pressure of the fluid in the first control conduit.

Another object of the invention is to provide pressure equalizing means to equalize pressure across the closure means of the flow control valve. The pressure equalizing means is opened in response to reducing fluid pressure in a supply line, and is closed by pressurizing the fluid in the supply line.

Another object of this invention is to use the inside volume of a suitable casing string which is cemented and sealed in a second well for storing pressurized gas. The pressurized gas stored in the casing of the second well is used to provide the necessary force to displace the liquid from the tubing to the casing annulus of the hydrocarbon producing well.

Other objects, features and advantages of the invention will be apparent from the drawings, the specification and the claims.

BRIEF DESCRIPTION OF THE DRAWINGS

In the drawings, like numerals indicate like parts and illustrative embodiments of the present invention are shown. For a detailed description of preferred embodiments of the invention, reference will be made to the accompanying drawings wherein.

DETAILED DESCRIPTION OF THE PREFERRED EMBODIMENTS

Figure 1:
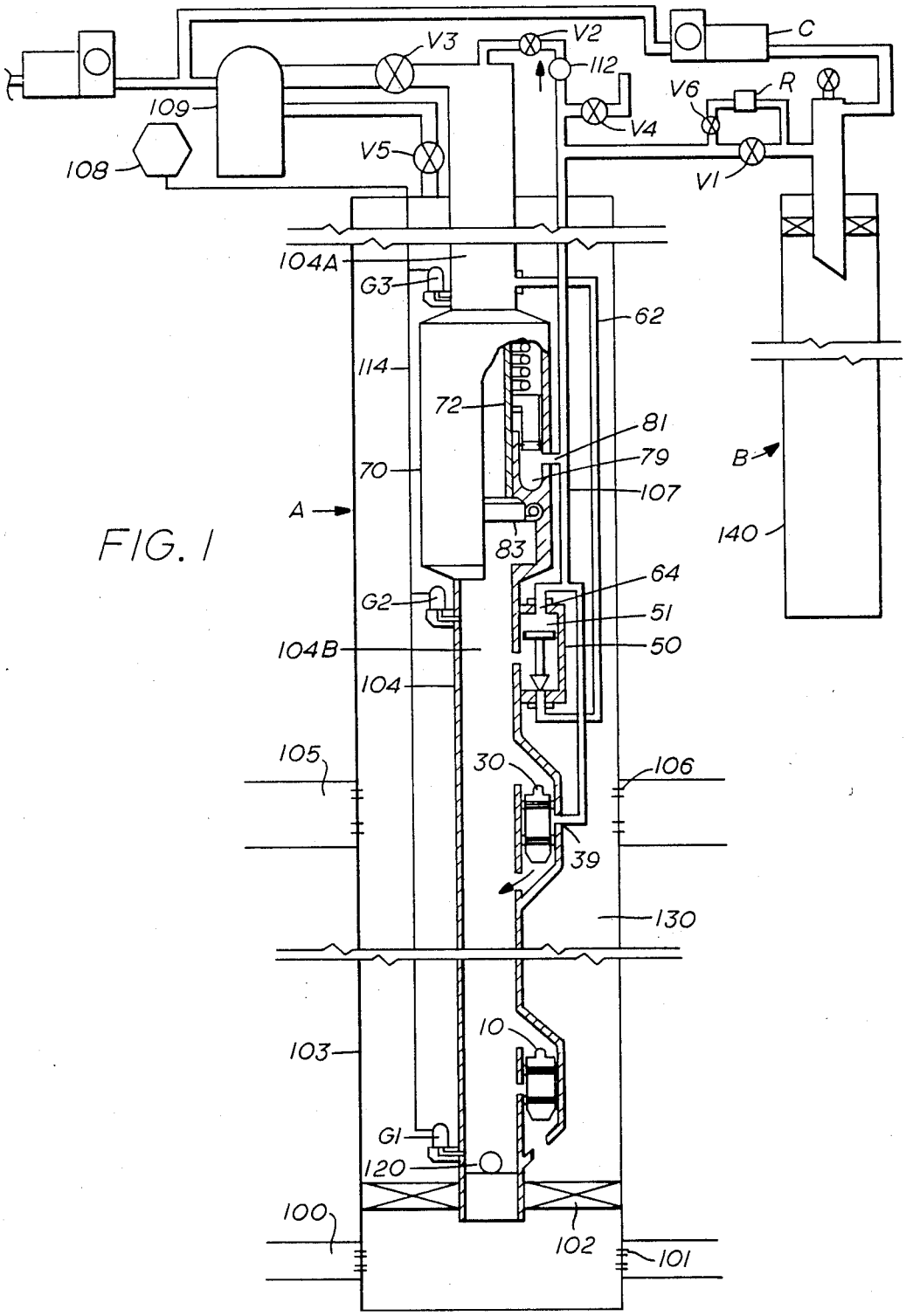
FIG. 1 is an elevational view, partially in section showing the liquid disposal system of the present invention.

In practicing the apparatus and method of the present invention, a hydrocarbon producing well is equipped with casing and tubing. Upper and lower flow control valves are connected to the tubing at predetermined depths with the upper flow control valve connected to the tubing above the lower flow control valve.

The upper and lower control valves are normally open allowing fluid production through the tubing, and when closed create an accumulation chamber to encapsulate the liquid which accumulates in the tubing between the valves. A hydrocarbon producing formation, and an upper water bearing formation are both open to the well bore. A seal means, such as a packer, is placed between the hydrocarbon producing formation and the water bearing formation. A passageway means, such as a relief valve, is connected to the tubing above the lower flow control valve. A gas supply conduit extends through the casing annulus from the surface and is connected to the tubing below the upper flow control valve. The gas supply line can be secured to the outside of the tubing in the casing annulus. High pressure gas is delivered through the gas supply line into the tubing string. Hydrocarbons from the hydrocarbon producing formation are produced through the tubing and flow to the surface production facilities. As the hydrocarbons are produced, other liquids, such as water, re produced which accumulate in the tubing. Periodically the lower flow control valve is closed to permit the liquids to accumulate inside the tubing. The upper flow control valve is closed to encapsulate the liquid that has accumulated in the accumulation chamber. Pressurized gas is then introduced through the supply conduit to pressurize the encapsulated liquid inside the accumulation chamber, i.e. that portion of the tubing between the flow control valves. The encapsulated liquid is then forced out of the tubing through a relief valve into the casing annulus. When the differential pressure in the accumulation chamber is reduced to the desired level, removal of the liquid is terminated. At this point, gas injection to the supply conduit is also terminated. The fluid pressure across the flow control valves is reduced and the flow control valves are opened. The producing well is opened to the surface production facilities with reduced back pressure due to the removal of the accumulated liquid from the tubing. In this method, a controller system is provided to control the closing and opening of the surface and subsurface valves. The controller may operate based on the fluid differential pressure inside the well tubing or the controller may be a timer which controls the sequence of opening and closing of the valves on regularly timed cycles.

In another embodiment of the invention, a water bearing formation may be located below the hydrocarbon producing formation. This embodiment is similar to the method described above, except that two packers and a bypass tube are used. The liquid is forced from the tubing into the casing annulus as previously described. When the liquid in the casing annulus rises to a sufficient height to overcome the pressure exerted by the water bearing formation, it is allowed to pass downwardly through the bypass tube to the water bearing formation. This alternative method allows the volume of pressurized gas required to displace liquids from the tubing into the casing annulus to be minimized because a smaller volume is required to be pressurized to force the liquid from the tubing to the casing annulus. Therefore, gas compression cost and the time lag between filling and venting the tubing are reduced.

Referring initially to FIG. 1, there is illustrated a hydrocarbon producing well A having a conventional casing 103 with perforations 101 providing fluid communication between the producing formation 100 and the interior of the casing 103. A tubing string 104 extends inside the casing 103, and a conventional packer 102 seals the lower part of the casing annulus about the tubing string 104. The hydrocarbon fluids are produced to the surface through tubing 104. Well B has a suitable string of casing 140 which is cemented and sealed to form, in effect, a pressure vessel. Well B is equipped with a proper wellhead and safety means. The casing of well B may be used as a storage tank for high pressure gas supply. The source for high pressure gas can also be a high pressure gas producing well or a gas sales line. Compressor C compresses gas from well A or other gas sources into the casing of well B to maintain the required pressurized gas volume in well B. A lower flow control valve 120, which in this embodiment is shown as check valve, is installed within the tubing 104 above packer 102 to prevent the downward flow of fluids within tubing 104.

An upper flow control valve 70 is disposed within the tubing 104 above the lower flow control valve 120. The upper flow control valve 70 is closed when desired to block the upward flow of fluids in the tubing 104. The setting depth of the upper flow control valve 70 is determined and optimized by the volume of liquids that has accumulated in the tubing 104 which cause the well to approach the "load up" condition. This liquid level limit can be determined by appropriate well tests such as bottom hole flowing pressure tests, and tests to determine the liquid level in the tubing. Several methods can be used to open or close the upper flow control valve 70. FIG. 1 shows one method in which the opening and the closing of the upper flow control valve 70 is controlled by the fluid pressure within the gas supply line 107 which extends in the casing annulus 130 from the surface.

A controller 108 is provided to initiate and control the operation of the system of FIG. 1. The controller 108 can be a microprocessor which controls the operation of the system of FIG. 1 based on the downhole fluid pressure differential in the tubing 104, or the controller 108 can be a timer controller which initiates and controls the operation of the system of FIG. 1 based on regularly timed cycles.

The microprocessor controller 108 receives electronic signals (milli amp or milli volt) from suitable pressure transmitters transmitting fluid pressure at different locations inside the tubing 104. The pressure transmitters may be connected to the well tubing 104 above packer 102 to communicate pressure conditions at different locations inside the tubing 104 to the controller 108. FIG. 1 shows the pressure transmitters G1, G2, and G3 which are in communication with the surface controller 108 via cable 114. Pressure gauge G1 is preferably connected to the tubing above the lower control valve 120 and pressure gauges G2 and G3 are connected to the tubing nearer to the upper flow control valve 70. The controller 108 receives electronic signals from pressure transmitters G1, G2, and G3. The controller 108 actuates the actuating means of valves V1, V2, V3, V4, V5, and V6 at the surface to cause each valve to move to its closed or open position.

The controller 108 detects the load up conditions of well A by determining the difference between the pressures at two or more locations in the tubing 104 such as pressures at transmitter G1 and the surface tubing pressure. This pressure difference is indicative of the back pressure exerted on the producing formation due to the weight of liquids inside the tubing 104.

When the back pressure due to the weight of the accumulated liquids in the tubing 104 exceeds a preset amount, the controller starts the liquid disposal process by actuating valves V3 and V6 to their closed positions to shut in well A. Prior to the start of the disposal process, valves V1, V2 and V4 are in their closed positions. The controller 108 then actuates valve V1 to its open position to allow pressurized gas to flow through the gas supply line 107. The pressurized gas enters the variable capacity pressure chamber 79 of the upper flow control valve 70 through port means 81 to actuate the upper flow control valve 70 to its closed position. The supply line 107 is also connected to port 64 through which the fluid pressure in the supply line 107 communicates with the gas pressure dome 51 of the equalizing valve means 50. The gas pressure in the supply line 107 maintains the equalizing valve means 50 in its closed position. Then the injection gas enters into the fluid injection control valve 30 which is a pressure operated valve means through the injection port 39. The injection gas pressure will overcome the closing forces of the fluid injection control valve 30 and actuate it to its open position to permit the injection gas to flow into the lower portion of the tubing string or accumulation chamber designated as 104B which is sealed off from the upper tubing portion 104A by the closed flapper 83 of the upper control valve 70 and from below by lower flow control valve 120. The injection gas pressurizes the fluids inside the accumulation chamber 104B. The pressurized fluid forces the disposal valve 10, which is connected to the tubing 104 above lower flow control valve 120, to its open position. The liquid in chamber 104B is displaced through the disposal valve 10 into the casing annulus 130 and disposed of through perforations 106 into the water bearing formation 105. The liquid can also be forced into the casing annulus and the accumulated liquid can be "U" tubed to surface facilities for storage and handling.

Referring still to FIG. 1, the controller 10B determines the end of the displacement process by monitoring the pressure differential inside the lower tubing section or accumulation chamber 14B using pressure signals transmitted by pressure transmitters G1 and G2. When it is determined that the pressure differential inside the accumulation chamber 104B is reduced to the desired level, gas injection into the supply line 107 is terminated. At this point, the controller 108 closes valve V1 to stop the gas injection and then opens valve V2 to connect the supply line 107 in flow communication with the tubing 104 to relieve the gas pressure inside the supply line 107 into the upper section 104A of the tubing 104. The pressure inside the supply line 107 can be reduced further to the desired level by venting gas through valve V4. Check valve 112 prevents back flow of gas from the tubing to the atmosphere. When the pressure inside the supply line 107 is reduced, the pressure inside the variable capacity pressure chamber 79 of the upper flow control valve 70, and the pressure dome 51 of the equalizing valve 50, are also reduced. The reduction of pressure in the dome 51 will cause the equalizing valve 50 to open and permit gas to flow from the accumulation chamber 104B through bypass 62, here shown to be a tube, into upper tubing section 104A of the tubing 104 to reduce fluid pressure across the flapper 83. The pressure equalization process continues until the opening forces acting upon the operator tube 72 of the upper flow control valve 70 overcome the forces due to a pressure differential that may exist across the flapper 83 and force the flapper 83 to its open position. Controller 108 detects the opening of the flapper 83 from the transmitted pressure differential signals received from the pressure transmitters. For example, if excessive pressure differential is measured by transmitters G2 and G3 across the flapper 83, it indicates to the controller 108 that the flapper 83 is closed. When the pressure differential across the flapper 83 is less than a preset amount indicating the opening of the flapper 83, the controller 108 opens valve V3 to return well A to its producing cycle for production to the sales line. The controller 108 closes valves V2 and V4 and opens valve V6 to allow the pressure regulator R to retain a predetermined amount of pressure in the supply line 107 to keep the equalizing valve 50 in the closed position. The compressor C pressurizes the storage well B to the desired pressure for the next disposal cycle. Other methods can be devised to achieve the functions of the pressure gauges, G1, G2, G3 without departing from the spirit of the present invention such as a liquid level transmitter to transmit the liquid level in the lower tubing 104B or a switch that is mechanically turned on or off by the operator tube 72 to indicate the closure or the opening of the flapper 83. During the disposal cycle, it is possible that gas is forced out along with liquid from the accumulation chamber 104B into the casing annulus 130. It is desirable to periodically vent the casing gas to the production facilities through valve V5 to reduce the casing annulus pressure.

Figure 2:
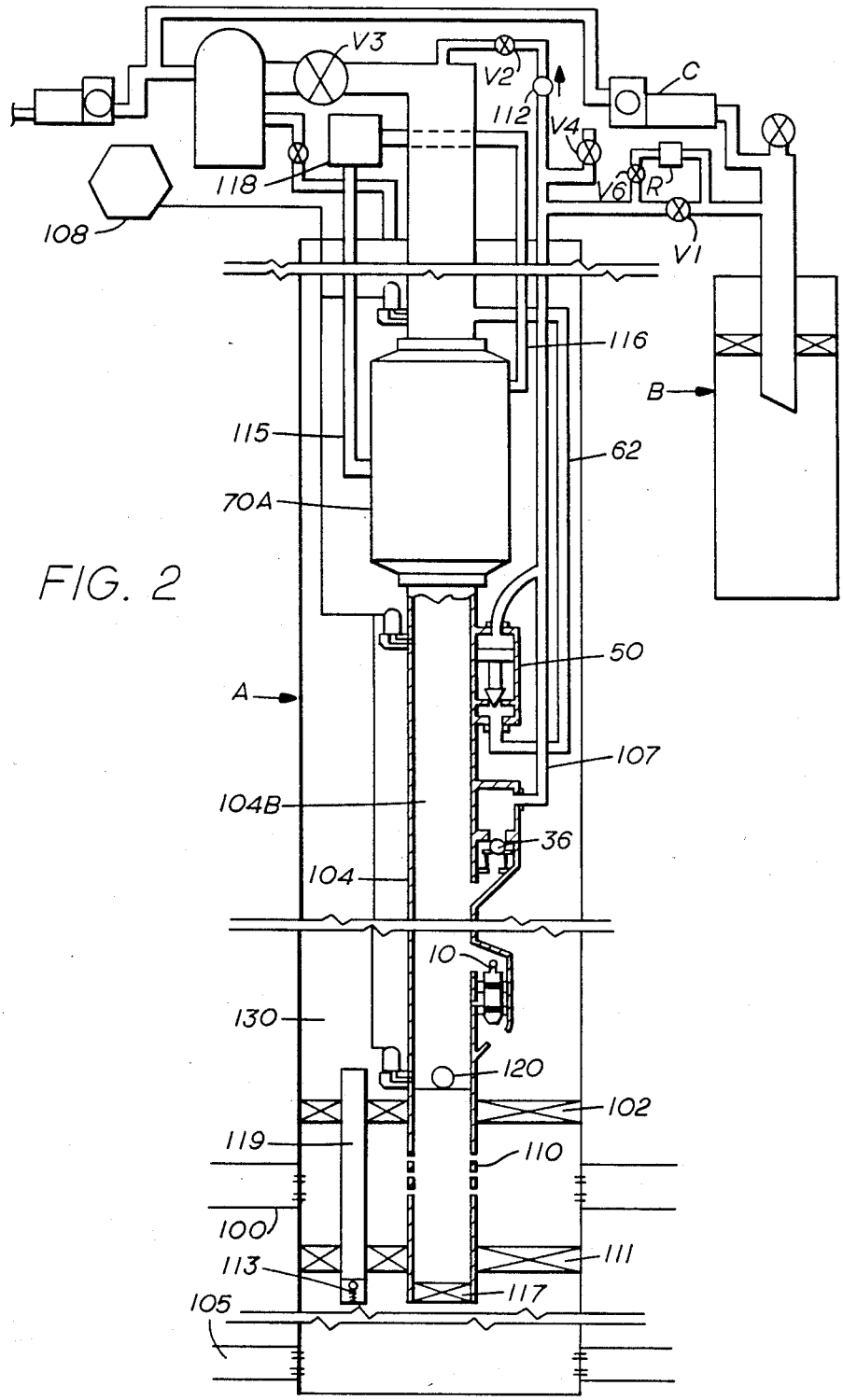
FIG. 2 is an elevational view, partially in section showing another embodiment of the liquid disposal system of the present invention.

Referring now to FIG. 2, there is shown another embodiment of the present invention. The water bearing formation 105 is shown in FIG. 2 below the hydrocarbon producing formation 100. Packers 102 and 111 are set above and below the hydrocarbon producing formation 100. Tubing 104 is sealed off as at 117. The tubing 104 includes a perforated nipple 110 which allows the produced fluids to enter into the tubing 104. The lower flow control valve 120, such as a check valve, permits upward flow of fluids in the tubing 104 but prevents the downward flow of such fluids. The closing and opening of the upper flow control valve 70A is controlled by two hydraulic control lines 115 and 116. The controller 108 initiates the liquid disposal cycle when desired by closing valve V3 to shut in well A. The controller 108 signals pressure manifold 118 to induce pressure to the fluid in the control line 115. The control fluid in turn acts on the operating means of the upper flow control valve 70A to move the closure means of the valve 70A to its closed position. The controller 108 closes valve V6, then opens valve V1 to allow pressurized gas to flow through the supply line 107. The pressurized gas enters into the lower tubing portion 104B below the closed upper flow control valve 70A. The pressurized gas pressurizes the fluids inside the lower tubing portion or accumulation chamber 104B and forces the liquid from the tubing 104 into the casing annulus 130 through the disposal valve 10. When the liquid in the casing annulus 130 rises to a sufficient height to overcome the water bearing formation pressure, it flows downwardly through a bypass tube 119 into the water bearing formation 105. Check valve 113 prevents the upward flow of liquids into the bypass 119. The controller 108 closes the pressurized gas to the supply line 107 when the differential pressure in the lower tubing section 104B is reduced to the desired level. The controller 118 then opens valve V2 to relieve the pressure in the supply line 107 into the upper tubing portion 104A. In the system depicted in FIG. 2, the pressure inside the supply line 107 is reduced to open the equalizing valve means 50 to reduce the pressure differential across the closure means of the upper flow control valve 70A. Then the controller 108 signals the pressure manifold 118 to relieve the induced pressure from the control line 115 and apply a predetermined amount of pressure to the fluid in the control line 116. The fluid pressure in the control line 116 in turn acts on the operating means of the upper flow control valve 70A to move the closure means of the upper flow control valve 70A to the open position. The operating means of a flow control valve operated by two hydraulic lines has been described. The controller then opens valve V3 to allow the fluid flowing up the well to flow into the sales line. Check valve 36 prevents the back flow of fluid from the tubing 104 into the supply line 107. Using hydraulic control lines to control the upper flow control valve 70A provides better control in opening the flow control valve because a greater opening force can be provided. The disadvantage is the additional expense in providing control lines and means to pressurize the fluid in the control lines.

Figure 3:
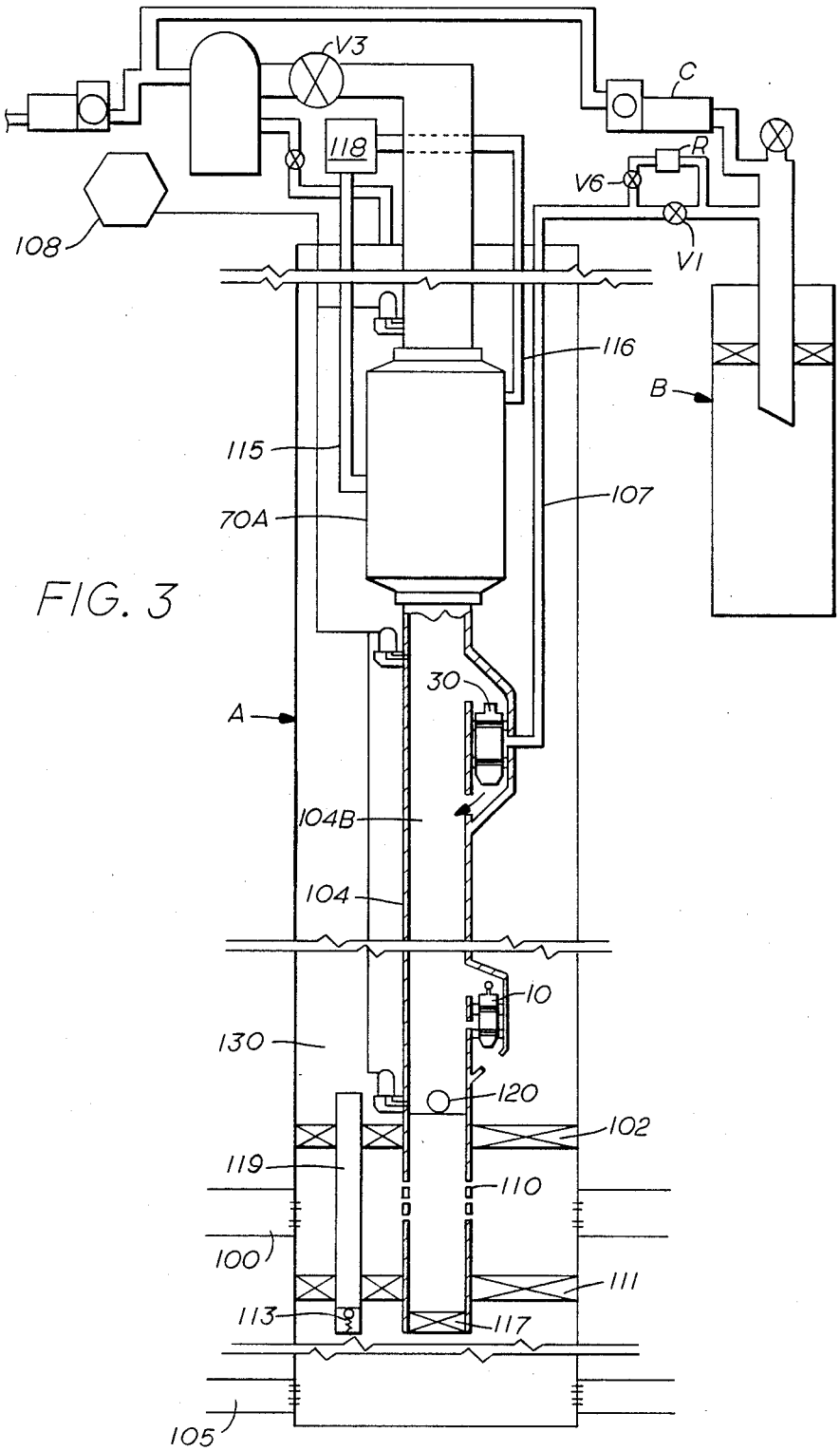
FIGS. 3 and 4 are elevational views, partially in section, showing other embodiments of the liquid disposal system illustrated in FIG. 2.
Figure 4:
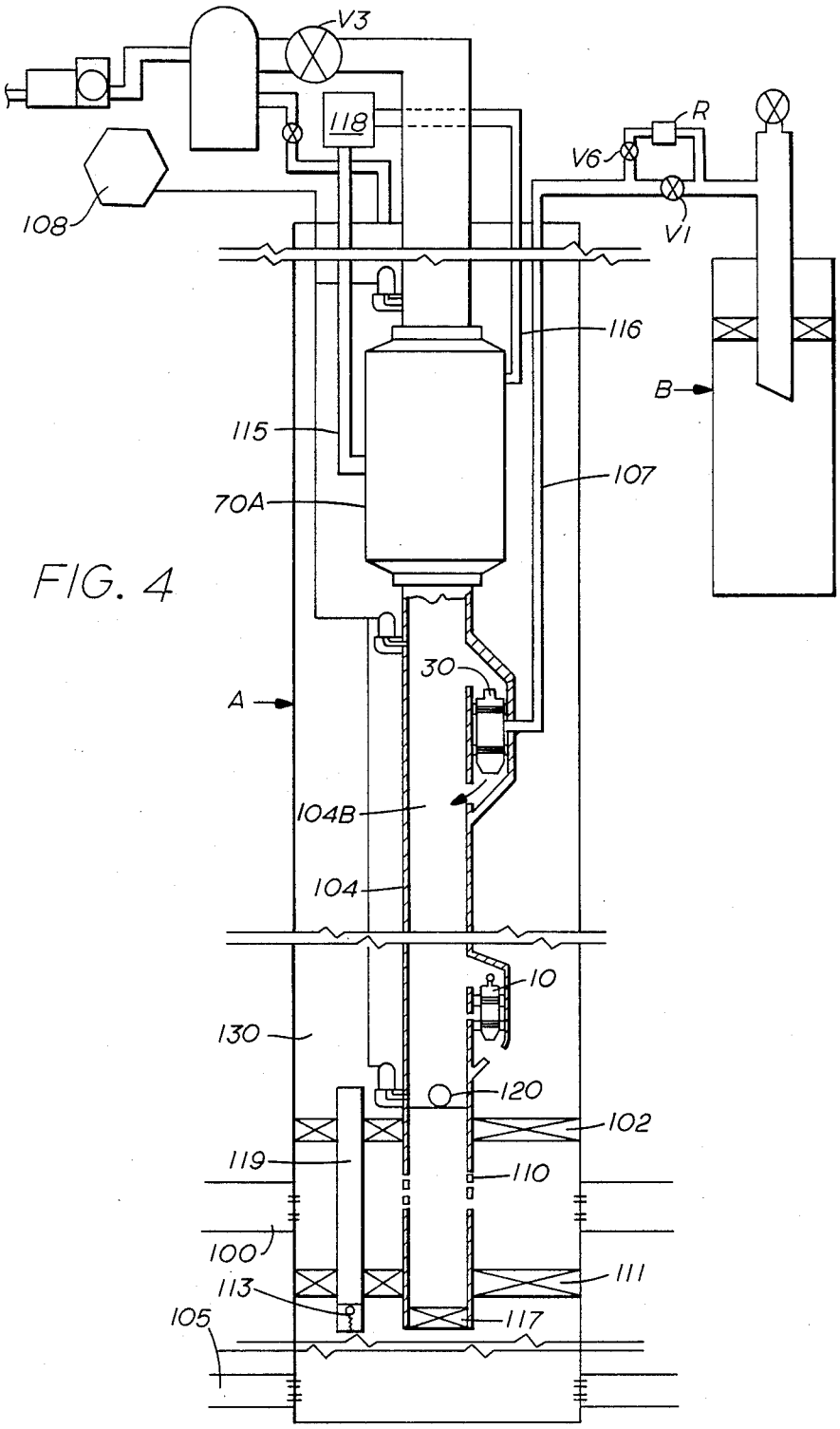

Another embodiment of the invention illustrated in FIG. 2 is shown in FIGS. 3 and 4. As in the embodiment of FIG. 2, the closing and opening of the upper flow control valve 70A is controlled by two hydraulic control lines 115 and 116. In the embodiments of FIGS. 3 and 4, however, the supply line 107 is used only to transfer the high pressure gas to the accumulation chamber or lower tubing portion 104B. In the embodiment of FIG. 2, the supply line 107 was also used to pressure and relieve pressure for closing or opening the valve 50. However, with a separate system controlling the valve 50, that function of the supply line 107 is not necessary. With the two functions separated, the need for the relief of high pressure gas from the supply line 107 is eliminated. The embodiments of FIGS. 3 and 4 permit the size of the supply line 107 to be of a larger diameter than if the supply line 107 is to perform both functions. When both functions are performed, a small diameter supply line 107 would be chosen due to the pressurizing and depressurizing cycles. With a larger supply line 107, there is the advantage of accelerating the transfer of the high pressure gas into the accumulation chamber or lower tubing portion 104B for the most efficient removal of liquids. Further, the embodiments of FIGS. 3 and 4 eliminate the need for valves V2, V4 and 112.

As shown in the embodiment of FIG. 4, the need for the compressor C may also be eliminated. By having a high pressure gas requirement which is simplified and direct, an alternative source of high pressurized gas is nitrogen. Nitrogen can be obtained in liquid form and transported in sufficient volumes to the wellsite and can be converted at the wellsite to high pressure gas as high as 10,000 PSI. Accordingly, nitrogen or other gases can be used to purge the liquids in the accumulation chamber 104B by introduction of the nitrogen or other gases through the supply line 107.

Figure 5:
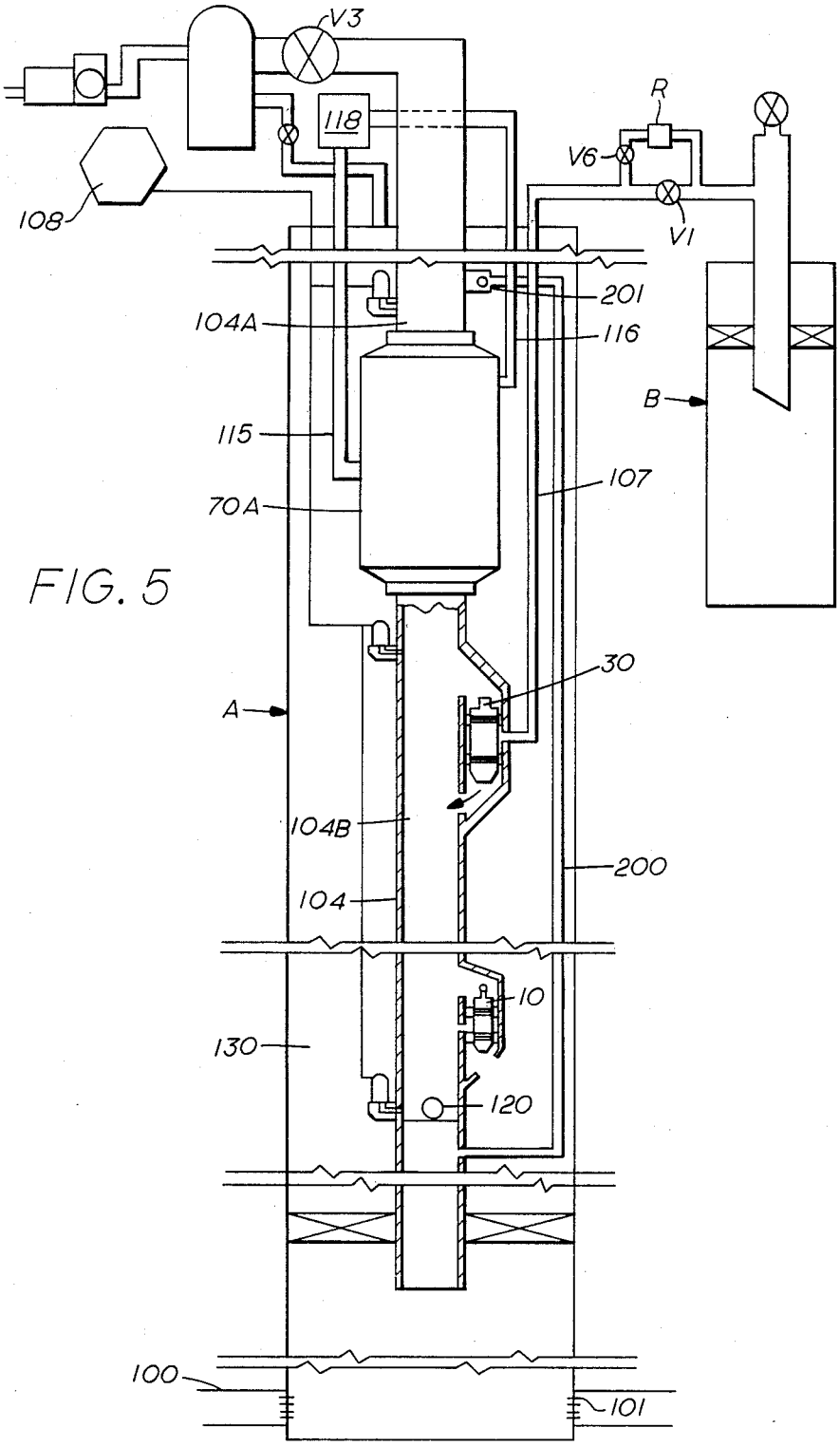
FIG. 5 is an elevational view, partially in section, showing another embodiment of the present invention having a bypass means.

Referring now to FIG. 5, there is shown another alternative embodiment of the present invention which provides a bypass means for bypassing the accumulation chamber 104B while the upper flow control valve 70A is in the closed position during the liquid removal cycle. The bypass means includes a bypass tubing 200 which provides fluid communication between the flow bore of that portion of the tubing below lower flow control valve 120 and the floW bore of the tubing 104A above the upper flow control valve 70A. Check valve means 201 is provided in bypass tubing 200 adjacent tubing 104A to prevent the backflow of fluid from within the flow bore of upper tubing 104A into the bypass tubing 200. Thus, the bypass means provides fluid communication between the producing formation 100 and the upper tubing 104A above upper flow control valve 70A to permit the release of pressure from the formation and to accelerate production. This may be particularly beneficial for low productivity formations. In other embodiments of the present invention, pressure is allowed to build up below the packer 102 as the upper flow control valve 70A is in the closed position during the liquid removal cycle.

Figure 6:
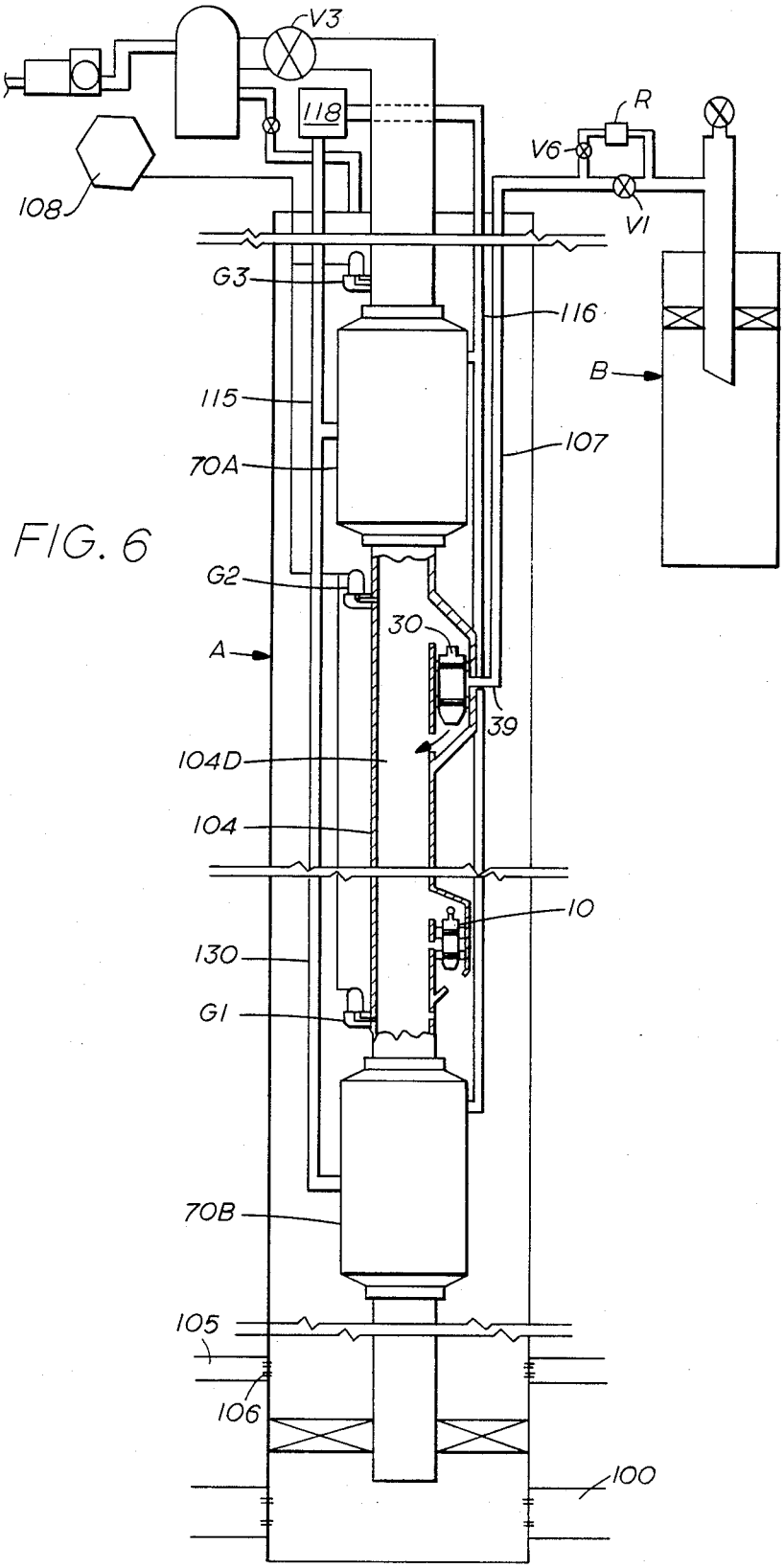
FIG. 6 is an elevational view, partially in section, showing the liquid disposal system of the present invention.

FIG. 6 shows still another embodiment of the apparatus of the present invention. In this embodiment upper and lower flow control valves 70A and 70B are used to encapsulate part or all of the accumulated liquid in the tubing 104. The flow control valves 70A and 70B, both normally remain in open position allowing well fluid to flow through the tubing 104. The lower flow control valve 70B preferably has suitable closure means such as a ball. The flow control valves 70A and 70B can be connected to the tubing 104 at any desired depth. The setting depth and the distance between the flow control valves are optimized based on the amount of liquid that must be removed from the tubing 104. When the lower flow control valve 70B is in closed position, the tubing volume between the closure means of the lower flow control valve 70B and the closure means of the upper flow control valve 70A becomes the accumulation chamber 104B. Control means are provided to selectively control the closing and the opening of the flow control valves 70A and 70B. For example, in FIG. 6 the flow control valves 70A and 70B are shown to be controlled by two hydraulic control conduits 115 and 116 extending from surface of the well through the casing annulus to the flow control valves 70A and 70B. The hydrostatic pressure of the fluid in the control line 116 acts on the operating means of the flow control valves 70A and 70B to balance the hydrostatic pressure of the fluid in control line 115 which is being exerted on the operating means of the flow control valves 70A and 70B. The flow control valves 70A and 70B each have resilient urging means biasing each flow control valve to an open position. The opening forces stored in the resilient urging means of the lower flow control valve 70B is less than the opening forces stored in the resilient urging means of the upper flow control valve 70A. Thereby when the fluid in control line 115 is pressurized, the lower flow control valve 70B is closed first, then further pressurizing the fluid in control line 115 will result in closing the upper flow control valve 70A.

In operation, the controller 108 monitors the pressure differential at two or more locations inside the tubing 104. When this pressure differential exceeds a present amount, the controller 108 signals the pressure manifold 118 to induce pressure to the fluid in the control line 115. The control fluid in turn acts on the operating means of the lower flow control valve 70B and moves the closure means of the lower flow control valve 70B to its closed position. As previously stated, the closing pressure of the upper flow control valve 70A is higher than the closing pressure of the lower flow control valve 70B. Thereby the upper flow control valve 70A remains in the open position and the liquid in the tubing 104 above the lower flow control valve 70B accumulates on top of the closure means of the lower flow control valve 70B. The controller 108 actuates valve V3 to closed position. The controller 108 signals the pressure manifold 118 to induce additional pressure to the fluid in the control conduit 115 to close the upper flow control valve 70A and encapsulate the accumulated liquid in the accumulation chamber 104B. The controller 108 then actuates valve V1 to its open position to allow pressurized gas to flow through the supply line 107 and open the injection control valve 30. The pressurized gas will enter into the accumulation chamber 104B and force the disposal valve 10, which is connected to the tubing 104 above and adjacent to the lower flow control valve 70B, to its open position. The encapsulated liquid in the accumulation chamber 104B is displaced through the disposal valve 10 into the casing annulus 130.

Referring still to FIG. 6, the controller 108 determines the end of the displacement process by monitoring the pressure differential inside the accumulation chamber 104B using pressure signals transmitted by the pressure transmitters G1 and G2. When it is determined that the pressure differential inside the accumulation chamber 104B is reduced to a desired level, controller 108 stops gas injection into the supply line 107 by actuating valve V1 to closed position. Controller 108 actuates valves 70A and 70B to their open position by relieving the induced pressure from the control line 115. Pressure equalizing means may be provided to reduce pressure across the closure means of the flow control valves 70A and 70B to ease the opening of said flow control valves. Pressure manifold 118 may be used to induce fluid pressure into the control line 115 to provide additional opening force and accelerate the opening of the flow control valves 70A and 70B. The controller 108 opens valve V3 to allow the production well to produce into the production facilities.

Another form of the liquid removal system of the present invention employs a subsurface actuated flow control valve such as a flow control valve described in U.S. Pat. No. 3,980,135 in place of a surface controlled flow control valve. A subsurface controlled flow control valve is held open by the normal downhole pressure at the valve. It automatically closes when the downhole pressure drops below a predetermined level. After closure, applied tubing pressure in excess of the downhole pressure below the valve returns the valve to the open position. When a subsurface actuated flow control valve is used for this invention, the disposal cycle and the pressure equalization cycle procedures are the same as previously described with respect to the system of FIG. 1, except the subsurface actuated flow control valve is closed automatically when the downhole pressure at the valve depth drops below a predetermined amount. The controller detects the closure of the subsurface actuated flow control valve. One way the controller may detect the closure of the subsurface actuated flow control valve is from a decrease in the flowing tubing pressure at the surface. The controller closes the tubing to the production facilities and starts the liquid disposal procedure as described with respect to the system of FIG. 1. To open the subsurface actuated flow control valve the pressure across the closure means of the subsurface actuated flow control valve is equalized as described with respect to the system of FIG. 1. Then pressurized gas is introduced to the top of the tubing from the pressurized gas source to exceed the fluid pressure below the closed valve and force the subsurface actuated flow control valve to its open position. This system has the advantage of using a less expensive flow control valve than the systems of FIG. 1 and FIG. 2. However, to open the flow control valve, additional pressure must be supplied to the tubing which results in a less efficient system.

The system of this invention can also employ a conventional safety valve which is controlled by a single hydraulic control line, such as the safety valves described in U.S. Pat. Nos. 4,376,464 and 4,161,219, to substitute the flow control valve of the system of FIG. 2. Generally, these types of valves are biased to the closed position and are opened in response to fluid pressure applied from the surface through a control line. These types of safety valves are limited in their depth of operation because resilient urging means biasing the safety valve to a closed position must overcome the hydrostatic head pressure in the hydraulic control line. These types of flow control valves can be used in a liquid removal system for a shallow well.

As stated, the present invention utilizes flow control valves to create a temporary liquid accumulation chamber in the tubing of a hydrocarbon producing well. Examples of fluid operated flow control valves, better known as safety valves, may be found in U.S. Pat. Nos. 4,252,197; 4,161,219; and 4,452,310. The present invention includes a method to modify these types of safety valves to better serve the objectives of the present invention. For the purpose of illustration, the modification will be shown as incorporated in a flapper type safety valve, such as a piston actuated well safety valve described by Pringle in U.S. Pat. No. 4,252,197. It will be understood that the present invention may utilize other modified flow control valves, such as tubing retrievable, or wire line retrievable control valves. Flow control valves having various other types of valve closing elements, such as ball or poppet elements, may be used. Similarly, other fluid operated valves with a closing and opening mechanism actuated by fluid flow or fluid pressure may be used.

Figure 7A:
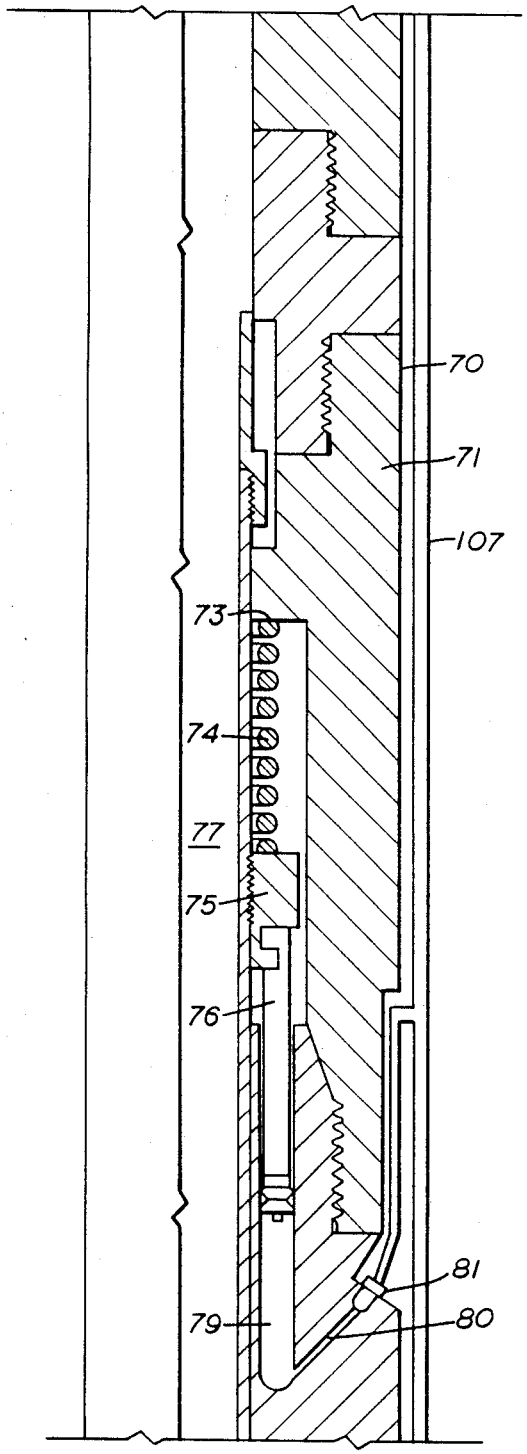
FIGS. 7A and 7B are continuations of a fragmentary elevational view, partly in cross section, of a flow control valve to control fluid in the well tubing and is shown in open position.
Figure 7B:
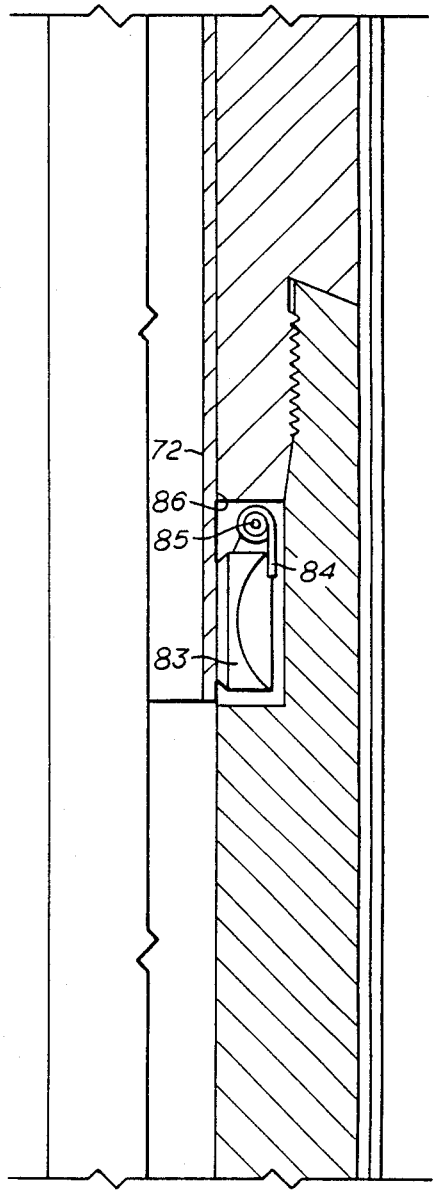

Referring now to FIGS. 7A and 7B, the flow control valve 70 of the present invention is shown as being of a tubing retrievable type. The flow control valve 70 generally includes a valve housing 71 that permits fluid to flow through bore 77. The flow control valve 70 includes a valve closure member such as a flapper 83 which is carried about a pivot pin 85. The flapper 83 may include a spring 84 for yieldably urging the flapper 83 about the pivot pin 85 and onto an annular valve seat 86 which is positioned about the bore 77 for closing valve 70 to block fluid flow from the lower tubing portion 104B to the upper tubing portion 104A.

An operator tube 72 is telescopically moveable in the housing 71 and through the valve seat 86. When the operator tube 72 is moved downward, the operator tube 72 pushes the flapper 83 away from the valve seat 86. Thus the flow control valve 70 is held in the open position. When the operator tube 72 is moved upward, the flapper 83 is allowed to move upward onto the seat 86 by the action of the spring 84. Several methods can be used to control the closing or opening of the flow control valve 70. One method is to control the closing and the opening of the flow control valve 70 by the application or removal of pressurized gas through the gas supply line 107 which is connected to the valve housing 71 at port means 81. In operation, when gas is injected into the supply line 107 from the surface, the gas pressure is applied to suitable hydraulic fluid in the pressurizing chamber 79 through passageway means 80 and the hydraulic fluid in turn applies pressure to the lower end of one or more pistons 76 which in turn engage the operator tube 72 such as by a tongue and groove connection 75 to move the operator tube 72 upward causing the flapper 83 to move to its seated position. When it is desired to open the flow control valve 70, the fluid pressure in the supply line 107 is reduced. Any suitable biasing means can be used such as a spring 74 or a pressurized gas chamber (not shown), which may act between a shoulder 73 on the valve housing 71 and against the upper end of the pistons 76 for yieldably urging the operator tube 72 in a downward direction to force the flapper 83 to its open position for opening the flow control valve 70. The upper end of the pistons 76 are exposed to the tubing pressure. Thus the tubing pressure acts on the upper end of the pistons 76 and provides additional force to move the operator tube 72 downward.

Figure 8:
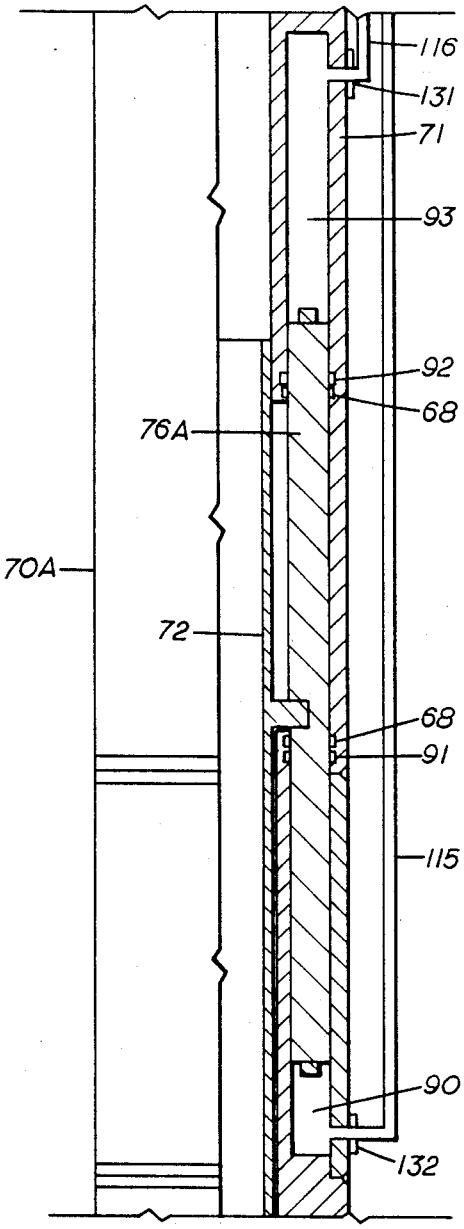
FIG. 8 is a fragmentary elevational view partly in cross section, of another form of actuating piston means for the flow control valve of this invention.

Referring now to FIG. 8, a further embodiment of the means for moving the tubular member 72 to upward and downward positions is shown. In this embodiment, hydraulic control line 116 is connected to the valve housing 71 at port means 131. The fluid pressure within the control line 116 communicates with the pressurizing chamber 93 through port 131. One or more pistons 76A which are telescopically moveable in the housing 71 are provided. The hydraulic control line 115 is connected to the housing 71 at port means 132. The fluid pressure within the hydraulic line 115 communicates with the pressurizing chamber 90 through port 132. The pistons 76A move in the pressurizing chamber 93 and are sealed therein by means of suitable seals 92. The pistons 76A can also move in the pressurizing chamber 90 and are sealed therein by means of suitable seals 91. Wiper means 68 are provided to prevent the engagement of solid matter with the pistons 76A. The piston assembly shown in FIG. 8 can be used to provide means to open and to close the closure means of the flow control valve of this invention in response to fluid pressure transmitted to the piston assembly through control lines 116 and 115.

In operation of the embodiment shown in FIG. 2, when control fluid within control line 116 is pressurized and the pressure in the control line 115 is reduced, the pistons 76A move the operator tube 72 downwardly and the upper flow control valve 70A is opened. When control fluid within control line 11 is pressurized and the pressure in the control line 116 is reduced, the pistons 76A move the operator tube 72 upwardly and the upper flow control valve 70A closes. Hydraulically controlled actuation means of the upper flow control valve 70A provide a better surface control for closing or opening of the upper flow control valve 70A than the actuation means of the upper flow control valve 70 of FIG. 1 which is controlled by the supply line pressure.

Figure 9:
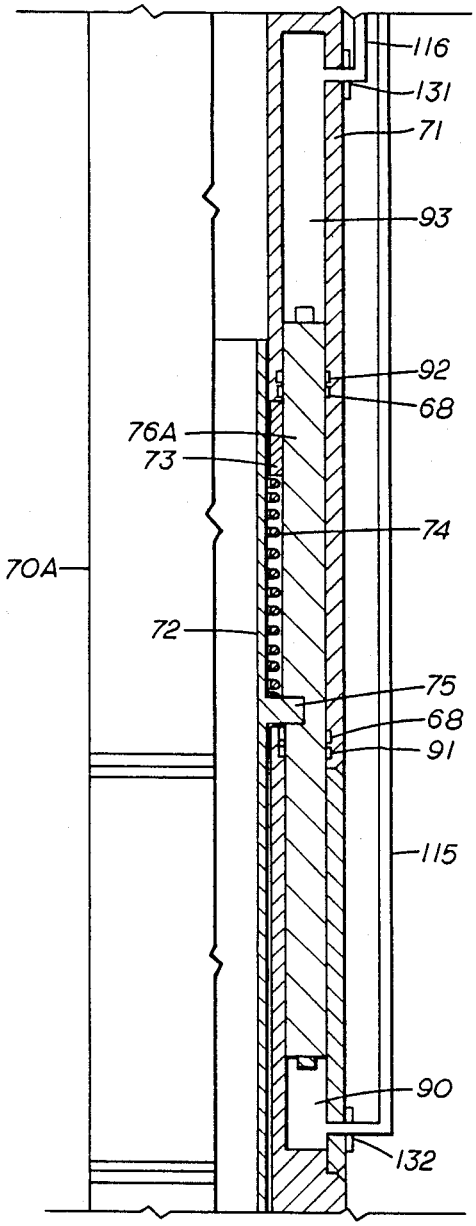
FIG. 9 is a fragmentary elevational view, partially in cross section, of an alternative actuating piston means for the flow control valve of this invention.

Referring now to FIG. 9, a further embodiment of the means for moving the tubular member 72 to upward and downward positions is shown. In this embodiment, the hydraulic control line 115 and the balance line 116 extend between the upper flow control valve 70A and the surface. The hydraulic control valve 116 is connected to the valve housing 71 at port means 131. The fluid pressure within the control line 116 communicates with the pressurizing chamber 93 through port 131. One or more pistons 76A which are telescopically moveable in the housing 71 are provided. The hydraulic control line 115 is connected to the housing 71 at port means 132. The fluid pressure within the hydraulic line 115 communicates with the pressurizing chamber 90 through port 132. The hydrostatic pressure of the fluid in the hydraulic line 116 balances the hydrostatic pressure of the fluid in the hydraulic control line 115. The pistons 76A move in the pressurizing chamber 93 and are sealed therein by means of a suitable seal 92. The pistons 76A can also move in the pressurizing chamber 90 and are sealed therein by means of suitable seals 91. A suitable resilient urging means such as spring 74, which may act between a shoulder 73 on the valve housing 71 and against the upper end of the tongue and groove connection 75, for yieldably urging the operator tube 72 in a downward direction to open the closure means of the flow control valve. Wiper means 68 are provided to prevent the engagement of solid matter with the pistons 76A. The piston assembly shown in FIG. 9 can be used to provide means to open and to close the closure means of the flow control valve of this invention in response to fluid pressure transmitted to the piston assembly through control lines 115 and 116.

In operation, due to the force of the resilient urging means 74, the operator tube 72 is normally in the downward position causing the closure means of the flow control valve to stay in the open position. When desired, the fluid within control line 115 is pressurized, causing the pistons 76A to move the operator tube 72 upwardly and the upper flow control valve 70A closes. Hydraulically controlled actuation means of the upper flow control valve 70A allows the valve to be set at any depth and provide a better surface control for closing or opening of the upper flow control valve 70A than the actuation means of the upper flow control valve 70 of FIG. 1 which is controlled by the fluid pressure in one control line.

U.S. Pat. No. 4,376,464 describes a safety valve in which the pistons moving the operator tube annularly surround the operator tube of the safety valve. This type of piston assembly can be modified for use in the flow control valve of the present invention to provide means to move the operator tube upwardly upon application of fluid pressure through the supply line 107 to the piston assembly.

Figure 10:
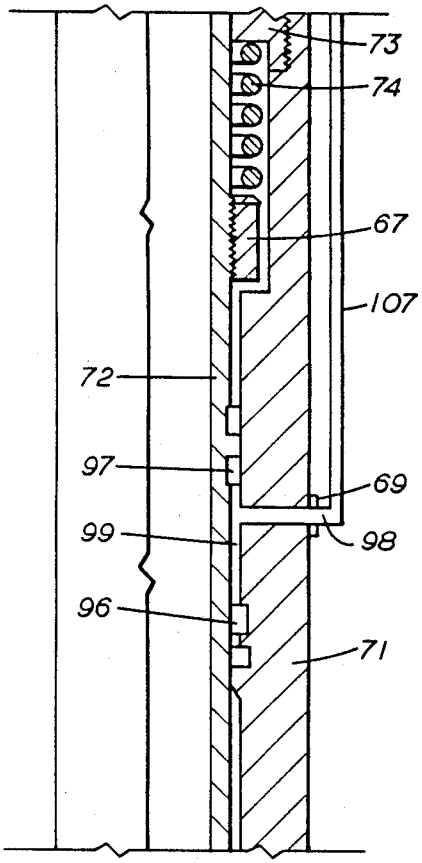
FIG. 10 is a fragmentary elevational view partly in cross section of another form of actuating piston means for the flow control valve of this invention.

FIG. 10 shows a piston assembly to control the movement of the operator tube 72. In this embodiment, suitable seals 96 and 97 provide a variable capacity pressure chamber for receiving fluid pressure from the supply line 107. The supply line 107 is connected at port 69 to the valve housing 71. There is a fluid passageway 98 leading from port 69 to a variable capacity chamber 99. The fluid under pressure enters the variable capacity chamber through passageway 98 and is confined between seals 96 and 97, but with seal 97 carried about the circumference of the operator tube 72, the fluid pressure causes the operator tube 72 to be moved upwardly. Any suitable resilient urging means 74 (here shown to be a spring) may be positioned between a shoulder 73 on the valve housing 71 and against the shoulder 67 on the tubular member 72 for yieldably urging the operator tube 72 in a downward direction to force the flapper 83 to its open position. The tubing pressure also acts on the upper end of the seal 97 and provides additional force to move the operator tube 72 downwardly. The piston assemblies moving the operator tube as shown in FIGS. 7A and 8 are preferred because the flow control valve's pressurizing chamber is out of communication with the operator tube 72, thereby eliminating the large seals about the operator tube 72.

Figure 11:
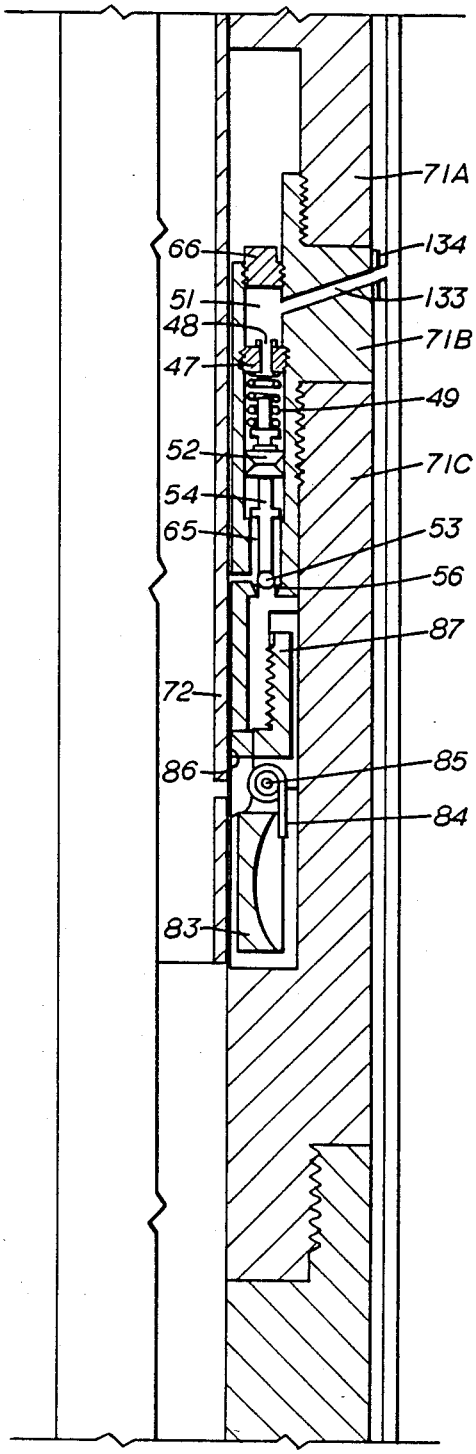
FIG. 11 is a fragmentary elevational view partly in cross section of an equalizing subassembly to equalize pressure across the closure means of the flow control valve of this invention.
Figure 13:
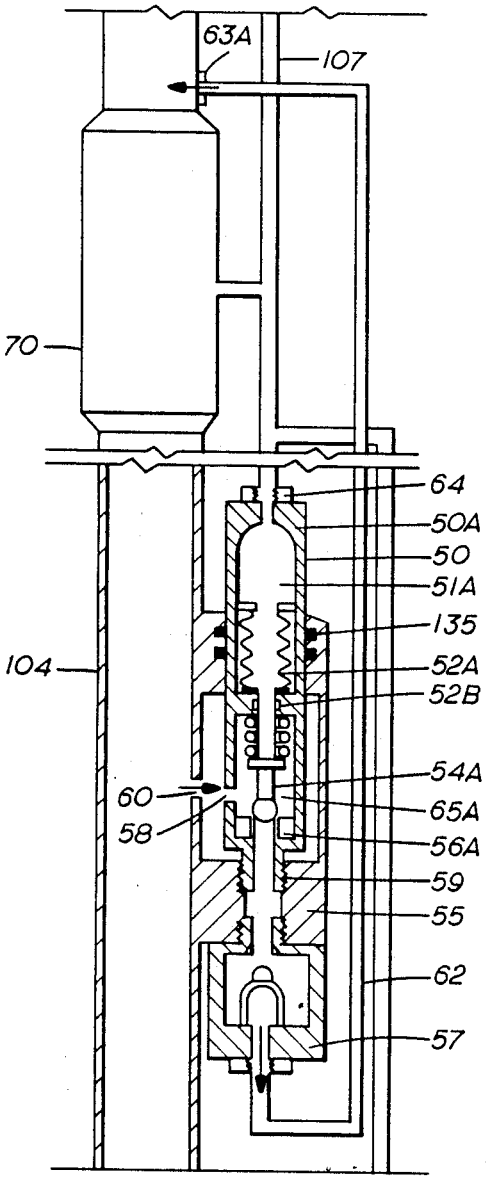
FIG. 13 is a vertical, partly sectional view of an equalizing valve positioned in a mandrel connected in the well tubing.

The present invention contemplates providing pressure equalizing means to reduce pressure across flapper 83 before opening the flow control valve 70. The flow control valve 70 may include an equalizing subassembly, as shown in FIG. 11, which is opened to equalize pressure across flapper 83. Another form of the equalizing means as shown in FIG. 13 can be connected to the well tubing to control bypassing of fluid pressure across flapper 83 through a bypass means.

Referring now to FIG. 11, in this embodiment the flow control valve 70 includes the equalizing subassembly 71B. The equalizing subassembly 71B is connectable in the flow control valve 70 between valve housing member 71A and 71C with the equalizing subassembly 71B extending axially between the operator tube 72 and the valve housing 71. As in U.S. Pat. No. 4,376,464, the threaded flapper subassembly 87 to which is attached the flapper valve 83 is secured to the equalizing subassembly 71B, by providing locking means such as plurality of set screws (not shown). In the housing of the equalizing subassembly 71B there is a longitudinal flowway 65 in which is housed a suitable pressure responsive means such as a piston rod 54 with piston seals 52 which are reciprocally moveable therein. The valve member 54 cooperates with seat 56 to control fluid flow through the flowway 65. The upper end of the flowway 65 is sealed by a suitable seal means such as a threaded bolt 66. Thus, a pressurizing chamber 51 is defined between the upper end of the piston seals 52 and the closed upper end of the flowway 65. The supply line 107 is connected to the equalizing subassembly 71B at port means 134. The pressurizing chamber 51 is in communication with the supply line 107 through passageway 133. A suitable choke means, such as threaded choke means 47 with passageway 48, is provided in the pressurizing chamber 51. The choke 47 provides a restriction to the flow of fluids in the pressurizing chamber 51. Viscous silicon fluid may be injected into the pressurizing chamber 51 during valve assembly to act as a damper during valve opening. Any suitable resilient urging means, such as a spring 49, may be provided to act between the lower end of the choke 47 and upper end of valve member 54 to assist in maintaining the valve member 54 in a closed position.

In operation, the pressure in the supply line 107 acts on the upper end of piston seals 52 and, assisted by the force of spring 49, urges valve member 54 to its seated position. During the disposal cycle, valve member 54 remains in a closed position because the closing forces that are acting on the valve member 54 are greater than the opening forces.

Figure 12A:
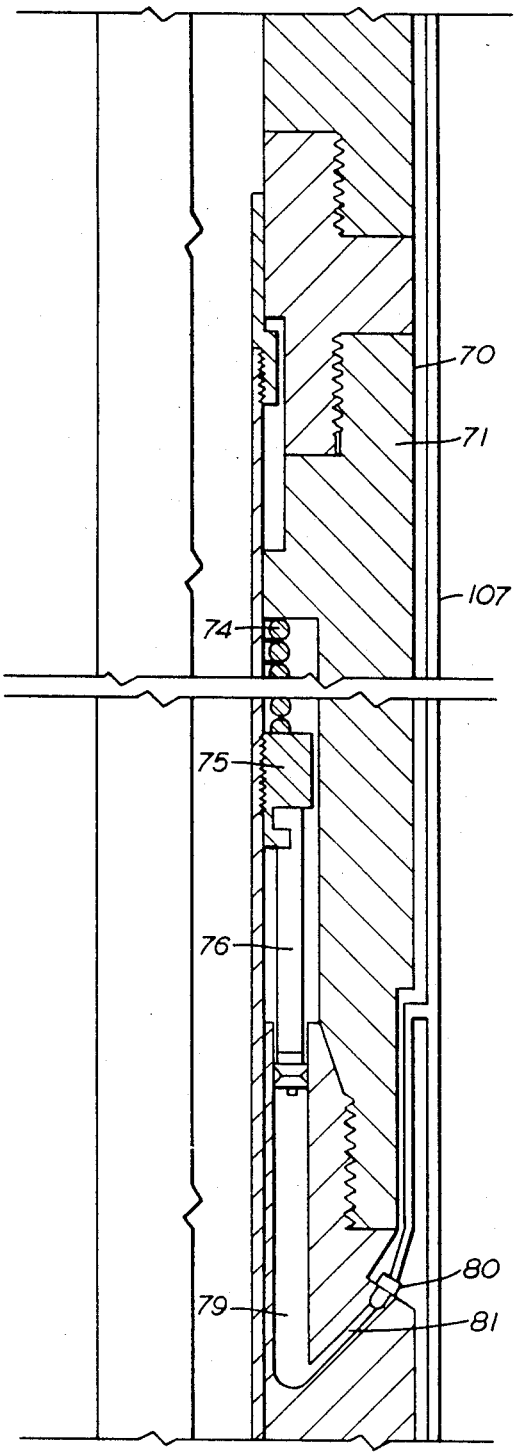
FIGS. 12A and 12B are continuations of a fragmentary elevational view, partly in cross section, of a flow control valve in the closed position and its equalizing subassembly in the open position.
Figure 12B:
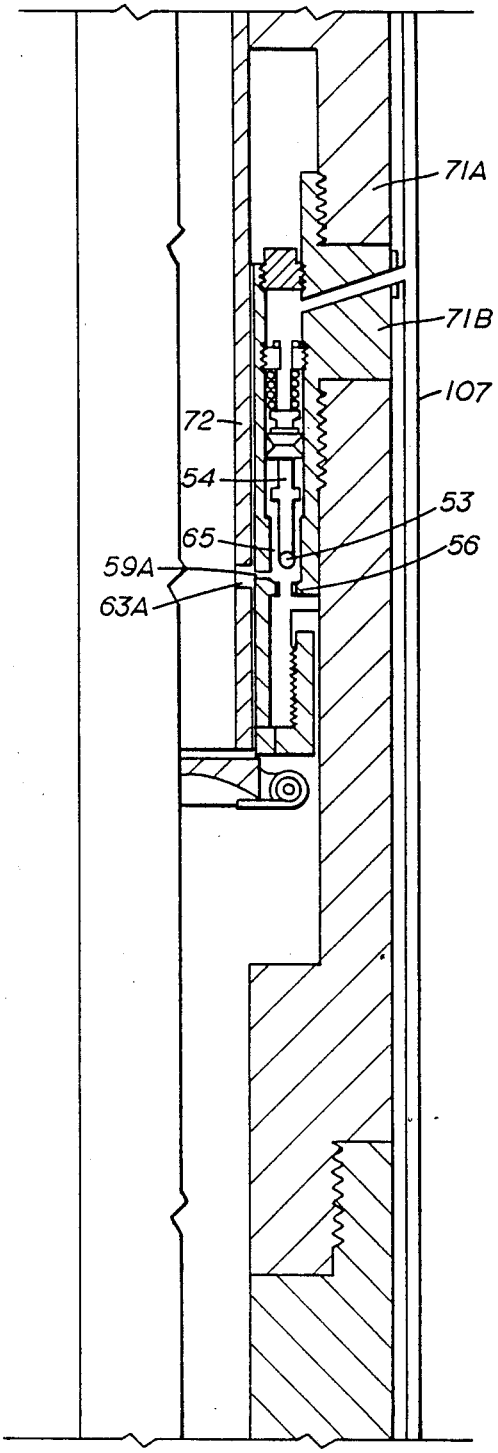

During the equalization process, the pressure inside the supply line 107 is reduced to open the equalizing valve means. The tubing pressure below the flapper 83 acts on the valve member tip 53 and the tubing pressure above flapper 83 acts on the lower end of piston 52 to move valve member 54 upward to its open position. FIGS. 12A and 12B show the flow control valve 70 in its closed position, and the equalizing subassembly 71B in its open position. When the equalizing valve is opened, gas flows from below the flapper 83 to the area above the flapper through passageway 65 and through one or more equalizing ports such as 59A and 63A which are provided in the equalizing subassembly 71B and the operator tube 72. FIG. 12B shows that the equalizing ports 63A and 59A are aligned when the flow control valve 70 is closed and the operator tube is in its upward position. Thus when the equalizing valve means opens, gas will flow through the equalizing ports 59A and 63A into the tubing.

Flapper 83 will remain in a closed position until the differential pressure across the flapper 83 is reduced to a point that the opening forces acting on the operator tube 72 move the operator tube 72 downward and move the flapper 83 to its open position. Additional pressure can be supplied to the dome 51 through the supply line 107 to assist spring 49 to move valve member 54 to its closed position. The pressure supplied to the dome 51 to close the equalizing valve means is less than the pressure required to overcome the opening forces of the flow control valve 70.

FIG. 13 shows another form of an equalizing means for connection to the tubing 104. The equalizing valve 50 is a dome pressure operated valve and has a housing 50A with a flowway 65A therein. The equalizing valve 50 has a threaded outlet 59 attached to the mandrel lug 55. The equalizing valve 50 is sealed against the internal wall of the mandrel lug 55 using suitable seals 135. The outlet 59 communicates with the bypass tube 62 through a check valve 57. Check valve 57 allows flow of fluid from the outlet of the equalizing valve 50 to the bypass tube 62 but prevents flow from the bypass tube 62 into the well tubing. The upper end of the bypass tube 62 is connected to the tubing 104 at port 63A. The equalizing valve 50 has an inlet 58 communicating with the fluid pressure inside the lower tubing portion 104B through inlet 60 of the mandrel 55. The equalizing valve 50 has a valve member 54A therein which cooperates with a seat 56A in the flowway 65A to control flow through the equalizing valve 50. The equalizing valve 50 has a pressure dome 51A which is in fluid communication with the supply line 107 through port 64. Thus, the pressure in the pressure dome 51A may be varied by changing the pressure inside the supply line 107. The pressure dome 51A is closed by a suitable pressure responsive means such as bellows 52A which is connected to the valve member 54A. The valve member 54A is moved downward to its seated position by dome gas pressure admitted through port 64 from the gas supply line 107 and is moved upwardly to open valve 50 by the pressure of fluids in the tubing 104. During the production cycle of the hydrocarbon producing well, it is desirable to keep the equalizing valve 50 in a closed position. This can be accomplished by maintaining fluid pressure to dome 51A through supply line 107. It is desirable to minimize the pressure in the supply line 107 during the production cycle of the hydrocarbon producing well to maintain valve 50 in the closed position. This is important when this type of equalizing means is used in a system where the flow control valve 70 is also controlled by the pressure in the supply line 107. The pressure in the supply line 107 during the production cycle should be less than the pressure that will close the flow control valve 70. The pressure required to maintain the equalizing valve 50 during the production cycle can be minimized by reducing the effective area where the tubing pressure is acting to open the valve 50. Suitable seals 52B are provided to seal off the bellows 52A from the effect of tubing pressure. Seals 52B may have a smaller area than the effective area of the bellows 52A. This will reduce the opening forces acting on the valve 50 due to the tubing pressure.

Figure 14:
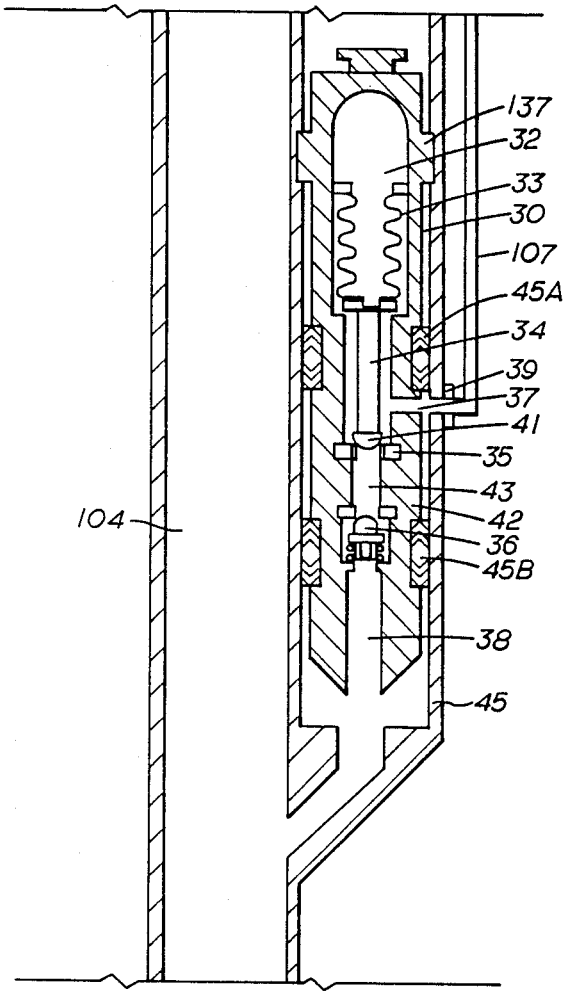
FIG. 14 is a cross sectional fragmentary view of an injection control valve positioned in a mandrel connected in the well tubing to control injection of pressurized gas into the well tubing.
Figure 16:
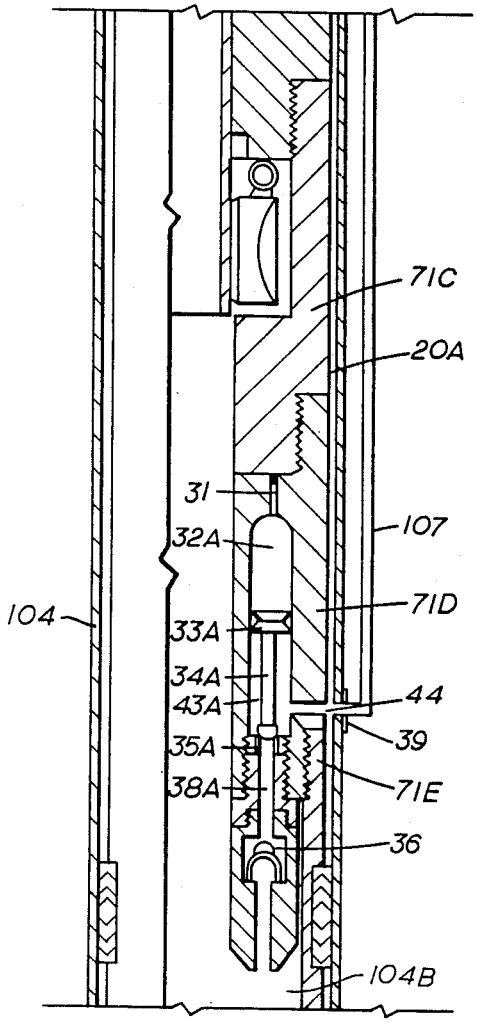
FIG. 16 is an elevational view, partially in section, showing an injection control subassembly.

FIG. 14 shows a wireline retrievable fluid injection control valve 30 which is similar to a dome pressure charged gas lift valve. One or more injection control valves are used to control the admission of pressurized gas into the accumulation chamber 104B. Valve 30 may also be used to control the sequence of the closure of the equalizing valve 50, closure of the flapper valve 83, and the start of the disposal process respectively. The injection control valve 30 may be a part of the flow control valve 70 as shown in FIG. 16 or can be a separate tubing retrievable or wireline retrievable valve for connection below the flow control valve 70 in the tubing 104 as shown in FIG. 14.

FIG. 14 shows a wireline retrievable fluid injection control valve 30 secured in the mandrel 45 using suitable lock means 137 and suitable seal means 45A and 45B. The supply line 107 is connected to the mandrel 45 at port 39. The valve 30 has a housing 42 with a flowway 43. The flowway 43 has an inlet 37 communicating with the supply line 107 through port 39. The valve 30 has a valve member 34 therein which cooperates with a seat 35 in the flowway 43 to control flow through the injection valve 30. The valve member 34 is urged toward a seated position by a charge of fluid under pressure in the dome 32 of the injection control valve 30. The dome is closed by suitable pressure responsive means such as bellows 33. In operation, the opening forces due to gas pressure provided by the supply line 107 acting upon bellows 33 and assisted by tubing pressure acting upon the valve member stem tip 41, overcome the closing forces due to the fluid pressure in the dome 32. This causes the bellows 33 to move upward and lift the valve stem tip 41 off the valve seat 35. The injection gas is then able to flow through the valve 30 and through outlet 38 into the lower tubing section 104B below the closed flapper 83.

Figure 15:
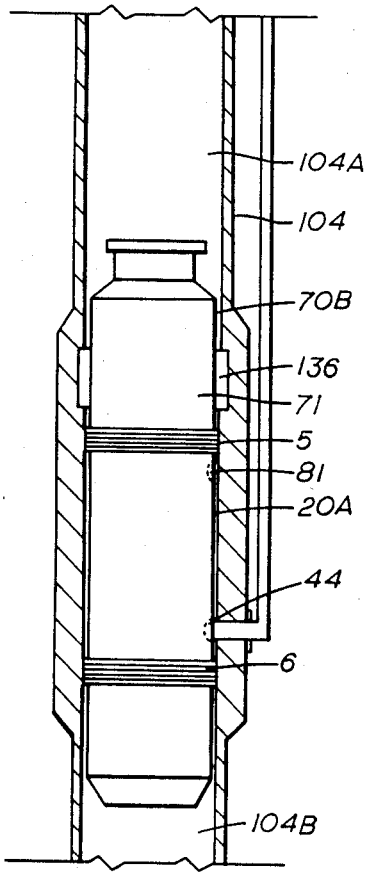
FIG. 15 is a fragmentary elevational view of a wireline retrievable flow control valve installed in a well tubing.

The pressure in the dome 32 is set to ensure that the injection control valve will not open until the gas pressure from the supply line 107 has actuated the flow control valve 70 and the equalizing valve 50 to their closed positions. Viscous silicon fluid is injected into the bellows 33 during valve assembly to act as a damper during valve opening. Reverse flow through valve 30 from the tubing 104 to the supply line 107 is prevented by a spring loaded check valve 36. Another embodiment of the fluid injection control assembly is shown in FIGS. 15 and 16 in which the flow control valve 70B includes a fluid injection control subassembly. FIG. 15 shows a flow control valve 70B, of a wireline retrievable type, for connection in a well tubing by a conventional lock 136. The flow control valve 70B has a housing 71 adapted to be positioned in the tubing 104 and sealed against the tubing 104 using suitable seals 5 and 6. The flow control valve 70B in addition to all the features of the tubing retrievable flow control valve 70 as previously described, may also include one or more fluid injection control subassemblies. FIG. 16 shows the injection control subassembly 71D for connection to the flow control valve 70B. The injection control subassembly 71D is connectable in the flow control valve 70B between valve housing members 71C and 71E. There is preferably disposed within said injection control subassembly 71D, a flowway 43A. Within flowway 43A is housed a valve member 34A cooperating with seat 35A in the flowway 43A to control flow of fluid in the flowway 43A. The supply line 107 is connected to the injection port 39 which is provided in the tubing 104. The flowway 43A has an inlet 44 which is exposed to the pressure in the supply line 107. The flowway 43A has an outlet 38A leading into the tubing 104. Valve member 34A includes pressure responsive means, such as piston 33A, capable of longitudinal sliding movement within the dome gas chamber 32A. The dome 32A is pressurized to a desired pressure through passageway 31 during valve assembly. The valve member 34A is urged to a downward and seated position by the pressure in the dome gas chamber 32A. In operation, the injection gas from the supply line 107 enters into the annulus 20A and through port 81 (shown in FIG. 15) into the pressure chamber 79 of the flow control valve 70B to close the valve 70B. When the opening forces acting on the piston 33A due to the gas pressure in the supply line 107 exceed the closing forces acting on the valve member 34A, valve member 34A moves upward and permits gas to flow from inlet 44 through outlet 38A into lower tubing section 104B to pressurize the fluid in the accumulation chamber 104B and force the liquids from the accumulation chamber 104B through a disposal valve to the casing annulus. Reverse flow through the injection valve subassembly 71D is prevented by a check valve 36.

Figure 17:
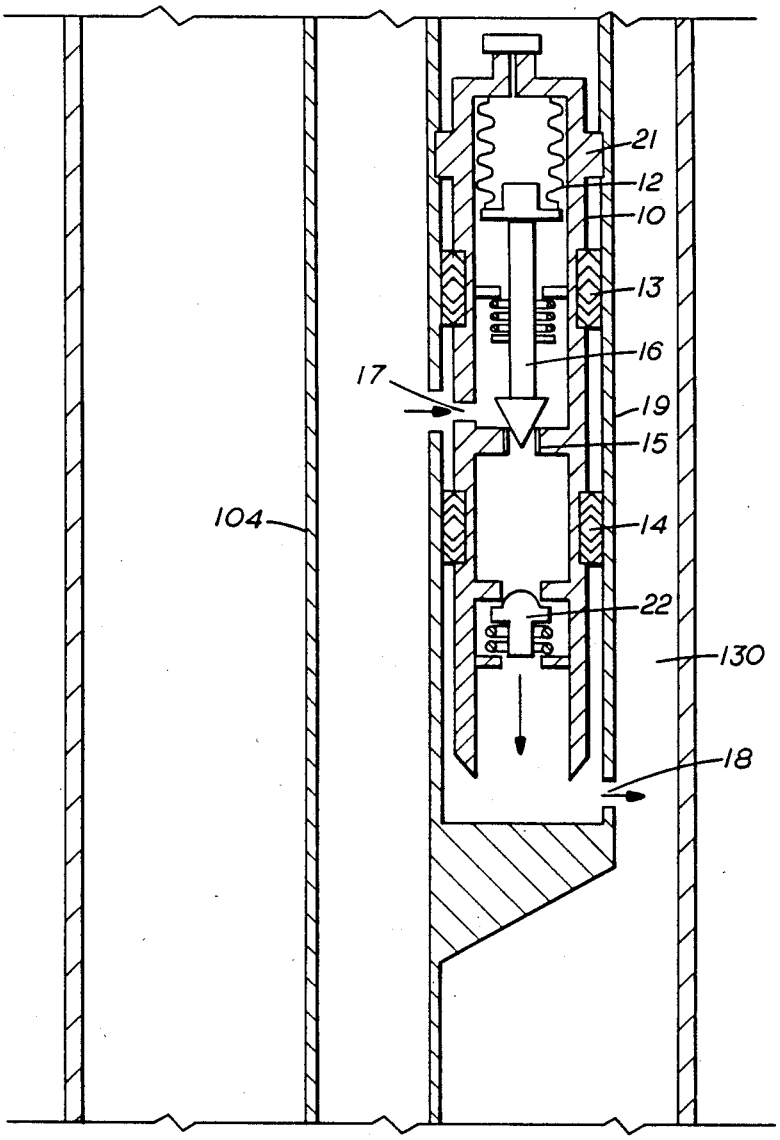
FIG. 17 is a cross sectional view of a disposal valve positioned in a mandrel connected in the well tubing.

FIG. 17 illustrates a wireline retrievable disposal valve 10 secured in the mandrel 19 using suitable lock means 21 and suitable seals 13 and 14. Valve 10 is a relief valve, which can be of a tubing retrievable or wireline retrievable type. The disposal valve 10 controls flow of fluid from the tubing into the casing annulus. The disposal valve 10 is a dome pressure charged and/or spring loaded relief valve which is subjected on one side to the fluid pressure in the interior of the tubing 104 and on the other side to the fluid pressure in the annulus 130. Valve 10 is preset to a desired opening pressure and will open to allow fluid to pass from the interior of the tubing 104 to the annulus 130 when the pressure inside the tubing 104 exceeds the pressure in the annulus by the preset amount. One or more disposal valves can be used to achieve the above objectives.

Referring to FIGS. 1 and 17, in operation, injection gas enters into the lower tubing section 104B, which is sealed off from the upper tubing section 104A by the closed flapper 83. The injection gas pressure and the hydrostatic pressure of the liquids in the lower tubing section 104B force the bellows 12 and the valve member 16 to move upwardly to let fluid from port 17 pass through seat 15 and through disposal port 18 to the annulus 130 for disposal. Check valve 22 is provided to prevent back flow of fluid from annulus 130 into the tubing 104.

Thus, it has been demonstrated that the method of present invention provides an advantage over the prior art in that the pressurized gas volume required to dispose of the undesired liquid from the well tubing is minimized and a better surface control is provided to control the frequency of the dewatering cycle of the hydrocarbon producing well.

While preferred embodiments of the invention have been shown and described, modifications thereof can be made by one skilled in the art without departing from the spirit of the invention.

What is claimed:

1. A method of removing accumulated liquids from a hydrocarbon producing well having a casing with perforations at a producing formation and perforations at a water bearing formation, said casing further having a string of well tubing disposed within it, the method of liquid removal comprising:

(a) sealing off a portion of said casing between a lower hydrocarbon producing formation and an upper water bearing formation;

(b) producing well fluids comprising hydrocarbon fluids and secondary fluids through the well tubing;

(c) providing a first flow control valve connected to the well tubing below the surface of the earth, said first flow control valve being normally open to allow well fluid production therethrough;

(d) providing a supply conduit to supply pressurized gas from a pressurized gas source to the well tubing, said supply conduit extending in the annulus between the tubing and the casing of said producing well and communicating with said well tubing through a port means below said first flow control valve;

(e) providing a passageway connected to the well tubing, through which liquid can be forced from the well tubing into the casing annulus;

(f) providing a second flow control valve means connected to the well tubing below said passageway to prevent downward flow of secondary fluids into the hydrocarbon producing formation;

(g) monitoring the pressure within the well tubing during hydrocarbon fluid production to the surface;

(h) actuating said first flow control valve to its closed position when said pressure inside the well tubing exceeds a predetermined amount to encapsulate the fluids in that portion of the well tubing between the first flow control valve and second flow control valve means;

(i) injecting pressurized gas through said supply conduit into the well tubing below the closed closure means of said first flow control valve to pressurize the fluid therein;

(j) forcing the secondary fluids from the well tubing through said passageway to the casing annulus with said pressurized gas to remove said secondary fluid from said well tubing and to displace said secondary fluids into the water bearing formation above the hydrocarbon producing formation;

(k) monitoring the pressure inside said well tubing due to the removal of said secondary fluid from the tubing;

(l) stopping the flow of said pressurized gas into said supply conduit to stop fluid removal when the pressure in said well tubing is at a desired level;

(m) opening said first flow control valve; and (n) opening the well tubing to surface facilities for production.

2. The method of claim 1 wherein the pressurized gas source for the supply conduit is nitrogen.

3. The method of claim 1 further including the step of providing fluid communication below the second flow control valve means to well tubing above the first control valve means to provide fluid communication with the producing formation.

4. The method of claim 3 further including the step of preventing the backflow of fluid from the well tubing above the first control valve means to the well tubing below the second control valve means.

5. The method of claim 1 further including the step of passing the pressure from the formation to the surface while the second control valve means is closed.

6. A method of removing accumulated liquids from a hydrocarbon producing well having a casing with perforations at a producing formation, said casing further having a string of well tubing disposed within said casing, the method of liquid removal comprising:

(a) providing upper and lower flow control valves in the well tubing for forming an accumulation chamber with the well tubing upon closing said valves;

(b) producing well fluids comprising hydrocarbon fluids and secondary fluids through the open upper and lower flow control valves and the string of well tubing communicating with the hydrocarbon producing formation;

(c) monitoring the accumulation of liquids in the well tubing;

(d) actuating the lower flow control valve to its closed position when the secondary fluids have accumulated beyond a predetermined amount;

(e) allowing the secondary fluids to accumulate in the well tubing above the lower flow control valve;

(f) actuating the upper flow control valve to its closed position to encapsulate the secondary fluids in the accumulation chamber; and (g) injecting pressurized gas through a supply conduit into said accumulation chamber to pressurize the fluid and force the fluid outside the well tubing through a valve passage way in the accumulation chamber.

7. The method according to claim 6 further including biasing the upper and lower flow control valves to the open position and pressurizing a control line from the surface to the upper and lower flow control valves for closing first the lower flow control valve and then the upper flow control valve.

8. The method of claim 7 further including the step of applying an opposing pressure to the hydrostatic pressure in said control line used for actuating the upper and lower flow control valves to equalize said opposed pressures.

9. The method of claim 6 further including biasing the upper and lower flow control valves normally open.

10. The method of claim 6 further including monitoring the accumulation of fluids above the lower flow control valve and actuating the upper flow control valve after the fluids have accumulated said predetermined amount.

11. The method of claim 6 further including the step of monitoring the displacement of the fluids from the accumulation chamber and opening the upper and lower flow control valves upon displacement.

12. The method of claim 6 further including equalizing the pressure across the flow control valves for ease of opening such valves.

13. The method of claim 6 further including inducing fluid pressure on the flow control valves to assist in opening such valves.

14. An apparatus for attachment to production tubing to remove liquid which has accumulated in the production tubing from the production of hydrocarbons, comprising:

(a) first valve means disposed above the point of entry of the hydrocarbons into the production tubing for preventing the back flow from the production tubing of hydrocarbons which have entered the production tubing;

(b) second valve means disposed in the production tubing above said first valve means for closing the flow bore of the production tubing and encapsulating the accumulated liquids in that section of the production tubing between said second valve means and said first valve means;

(c) gas supply means extending to said section of the production tubing and communicating with the flow bore of said section for pressurizing the flow bore within said section;

(d) outlet means disposed in said section for allowing the flow of the accumulated liquids out of the flow bore of said section of the production tubing upon pressurization of said section by said gas supply means; and (e) bypass means to bypass formation pressure from below said first valve means to the production tubing above said first valve means.

15. The apparatus of claim 14 further including a third valve means to prevent back flow of fluids from the production tubing above said first valve means to the production tubing below said first valve means.

16. A method of removing accumulated liquids from a hydrocarbon producing well having a casing with perforations at a producing formation and a string of well tubing disposed within the casing, the method of liquid removal comprising the steps of:

(a) providing upper and lower flow control valves in the well tubing for forming an accumulation chamber with the well tubing upon closing the valves;

(b) producing well fluids comprising hydrocarbon fluids and secondary fluids through the open upper and lower flow control valves and the string of well tubing communicating with the hydrocarbon producing formation;

(c) monitoring the accumulation of liquids in the well tubing;

(d) closing the lower flow control valve when secondary fluids have accumulated beyond a predetermined amount;

(e) preventing pressure build up below the lower flow control valve by relieving the formation pressure into the well tubing;

(f) allowing the secondary fluids to accumulate in the well tubing above the lower flow control valve;

(g) closing the upper flow control valve to encapsulate the secondary fluids in the accumulation chamber; and (h) injecting pressurized gas through a supply conduit into said accumulation chamber to pressurize the fluid and force the fluid through a valve passage way into the casing annulus.

* * * * *